US011421890B2

(12) United States Patent
Deshpande et al.

(10) Patent No.: US 11,421,890 B2
(45) Date of Patent: Aug. 23, 2022

(54) BURNER CAP FOR A BURNER ASSEMBLY

(71) Applicant: WHIRLPOOL CORPORATION, Benton Harbor, MI (US)

(72) Inventors: Alok C. Deshpande, Pune (IN); Victor H. Manrique, St. Joseph, MI (US); Ashish Mittal, Pune (IN); Binesh Raj Pillai, Navi Mumbai (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/114,674

(22) Filed: Dec. 8, 2020

(65) Prior Publication Data

US 2022/0178546 A1 Jun. 9, 2022

(51) Int. Cl.
*F24C 3/08* (2006.01)
*F23D 14/06* (2006.01)

(52) U.S. Cl.
CPC ..... *F24C 3/085* (2013.01); *F23D 14/06* (2013.01); *F23D 2203/10* (2013.01)

(58) Field of Classification Search
CPC ..... F23D 14/06; F23D 2203/10; F24C 3/085
USPC ..... 126/39 E, 39 R; 431/144
See application file for complete search history.

(56) References Cited

U.S. PATENT DOCUMENTS

| | | | |
|---|---|---|---|
| 2,521,936 | A | 9/1950 | Mueller |
| 3,921,913 | A | 11/1975 | Capy |
| 5,865,615 | A | 2/1999 | Simpson et al. |
| 6,017,211 | A | 1/2000 | Gort et al. |
| 9,726,371 | B2 | 8/2017 | Lin et al. |
| 9,951,958 | B2 | 4/2018 | Simms et al. |
| 10,228,128 | B2 | 3/2019 | Geng et al. |

FOREIGN PATENT DOCUMENTS

| | | | |
|---|---|---|---|
| AU | 593990 | B2 | 2/1990 |
| EP | 3410011 | A1 | 12/2018 |
| GB | 2224824 | A | 5/1990 |
| KR | 20020067116 | A | 8/2002 |
| WO | 2016096040 | A1 | 6/2016 |

*Primary Examiner* — Vivek K Shirsat
(74) *Attorney, Agent, or Firm* — Price Heneveld LLP

(57) ABSTRACT

A burner assembly includes a spreader and a burner cap coupled to the spreader. The burner cap includes a sheet metal base bounded by a peripheral lip and a sheet metal top extending over the sheet metal base to define a gap and having a peripheral rim that wraps about at least a portion of the peripheral lip. The sheet metal base defines at least one port configured to allow air to flow into and out of the gap.

19 Claims, 4 Drawing Sheets

BURNER CAP FOR A BURNER ASSEMBLY

BACKGROUND OF THE DISCLOSURE

The present disclosure generally relates to a burner cap for a burner assembly, and more specifically, to a burner cap having a sheet metal top and a sheet metal bottom that defines at least one port.

SUMMARY OF THE DISCLOSURE

According to one aspect of the present disclosure, a burner cap includes a sheet metal base. The sheet metal base includes a peripheral lip that bounds the sheet metal base, an inner platform positioned inboard of the peripheral lip, and an annular trough positioned between the peripheral lip and the inner platform. The burner cap also includes a sheet metal top that extends over the sheet metal base to define a gap there-between and having a peripheral rim that wraps about at least a portion of the peripheral lip to couple the sheet metal top to the sheet metal base. The sheet metal base defines at least one port configured to allow air to flow into and out of the gap.

According to another aspect of the present disclosure, burner assembly includes a spreader and a burner cap coupled to the spreader. The burner cap includes a sheet metal base bounded by a peripheral lip and a sheet metal top extending over the sheet metal base to define a gap and having a peripheral rim that wraps about at least a portion of the peripheral lip. The sheet metal base defines at least one port configured to allow air to flow into and out of the gap.

According to yet another aspect of the present disclosure, a burner cap includes a base bounded by a peripheral lip and a top extending over the base to define a gap between the top and the base and having a peripheral rim that wraps about at least a portion of the peripheral lip. The base defines at least one port configured to allow air to flow into and out of the gap.

These and other features, advantages, and objects of the present disclosure will be further understood and appreciated by those skilled in the art by reference to the following specification, claims, and appended drawings.

Figure 1:
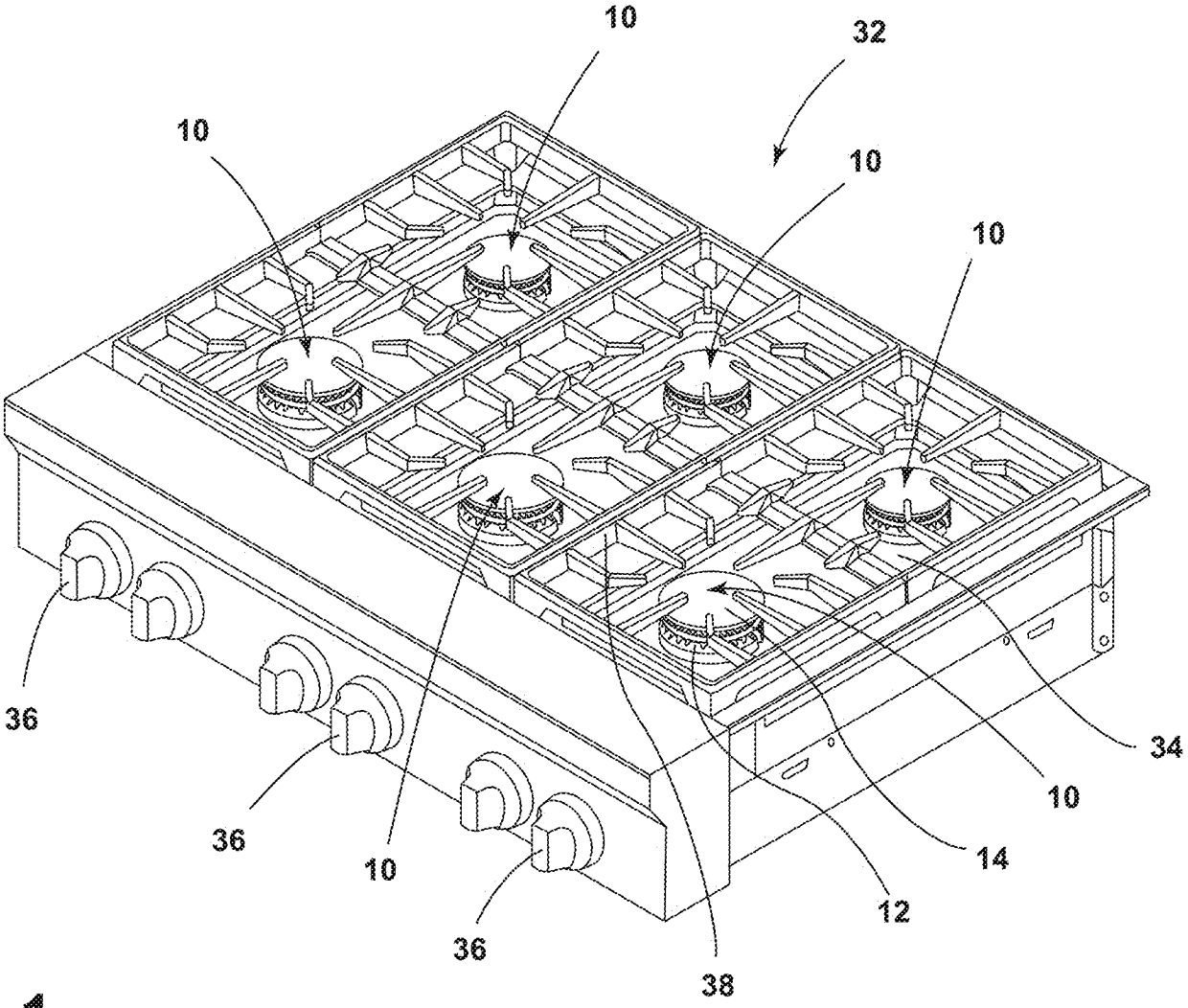
FIG. 1 is a top perspective view of a range that includes a plurality of burner assemblies.

The components in the figures are not necessarily to scale, emphasis instead being placed upon illustrating the principles described herein.

DETAILED DESCRIPTION

The present illustrated embodiments reside primarily in apparatus components related to a burner cap. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring to FIGS. 1-7, a burner assembly 10 includes a spreader 12 and a burner cap 14 coupled to the spreader 12. The burner cap 14 includes a base 16. The base 16 includes a peripheral lip 18 that bounds the base 16, an inner platform 20 positioned inboard of the peripheral lip 18, and an annular trough 22 positioned between the peripheral lip 18 and the inner platform 20. The burner cap 14 further includes a top 24 that extends over the base 16 to define a gap 26 there-between. The top 24 includes a peripheral rim 28 that wraps about at least a portion of the peripheral lip 18 to couple the top 24 to the base 16. The base 16 defines at least one port 30 to allow air to flow into and out of the gap 26.

With reference to FIG. 1, a range 32 is illustrated. The range 32 includes a cooktop 34 and a plurality of burner assemblies 10 coupled to the cooktop 34. The burner assemblies 10 may be configured to burn gas to produce heat for cooking purposes. In the embodiment illustrated in FIG. 1, a plurality of knobs 36 are coupled to the range 32 and configured to control heat output from the burner assemblies 10 by regulating the flow of gas out of the burner assemblies 10. Further, a grate 38 for receiving a cooking vessel thereon extends over the plurality of burner assemblies 10.

Figure 3:
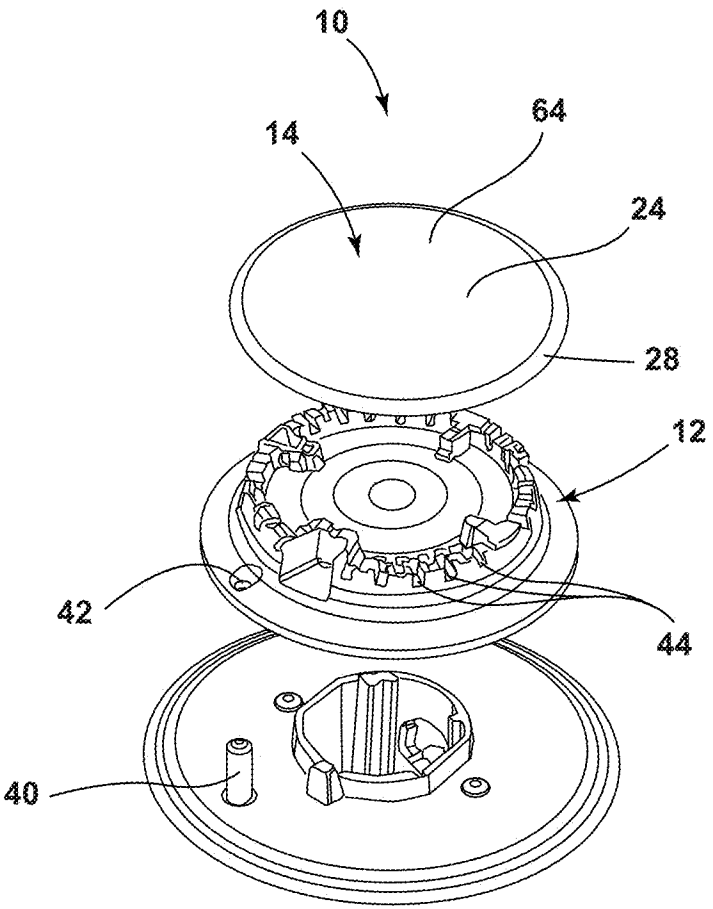
FIG. 3 is an exploded view of a burner assembly having a spreader and a burner cap.
Figure 2:
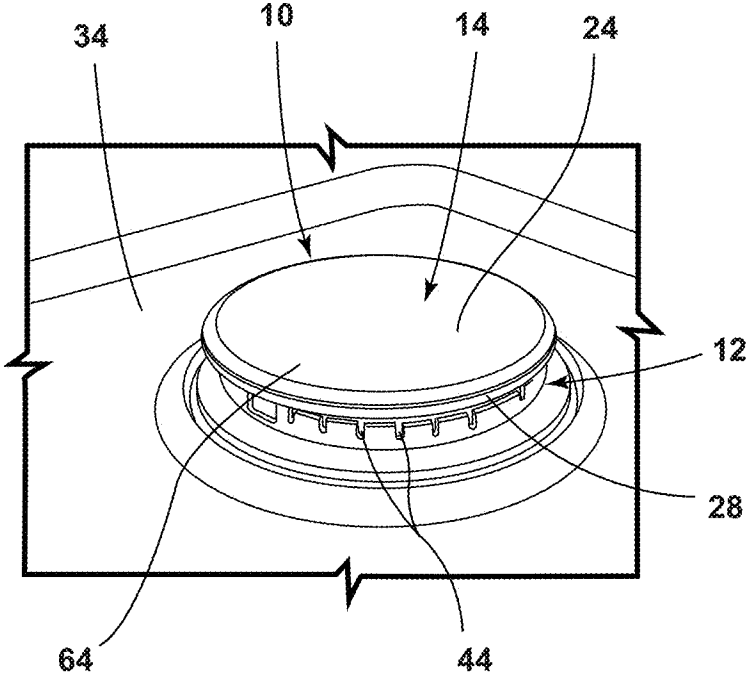
FIG. 2 is a top perspective view of a burner assembly having a spreader and a burner cap.

Referring now to FIGS. 2 and 3, an exemplary burner assembly 10 is illustrated. The burner assembly 10 includes an ignition electrode 40, the spreader 12, and the burner cap 14. The ignition electrode 40 is configured to produce a spark to ignite gas supplied to the burner assembly 10. In the embodiment illustrated in FIG. 3, the ignition electrode 40 extends upward through a receiving aperture 42 defined by the spreader 12. As illustrated in FIG. 1, the spreader 12 is positioned generally upward of the cooktop 34 between the cooktop 34 and the burner cap 14. The spreader 12 includes a plurality of gas outlets 44 spaced apart from each other, such that flames resulting from the ignited gas escape the spreader 12 in a distributed manner. The burner cap 14 is coupled to the spreader 12. In various implementations, the burner cap 14 may contact the spreader 12, such that the burner cap 14 rests upon and/or is positioned atop the spreader 12. It is contemplated that the burner cap 14 may be coupled to the spreader 12 indirectly through an additional component positioned between the burner cap 14 and the spreader 12. A variety of types of burner assemblies 10 are contemplated.

Referring now to FIGS. 4-7, the burner cap 14 includes the base 16 and the top 24. In various implementations, the base 16 and the top 24 of the burner cap 14 may be comprised of sheet metal. As such, the base 16 may be a sheet metal base 16, and the top 24 may be a sheet metal top 24. As illustrated in the plan view of an exemplary embodiment of the base 16 depicted in FIG. 6, the base 16 may be generally disc-shaped. In other words, from a top-down perspective, the base 16 may have a generally circular outline. The base 16 of the burner cap 14 is bounded by the peripheral lip 18. In some implementations, the base 16 is radially bounded by the peripheral lip 18.

Figure 5:
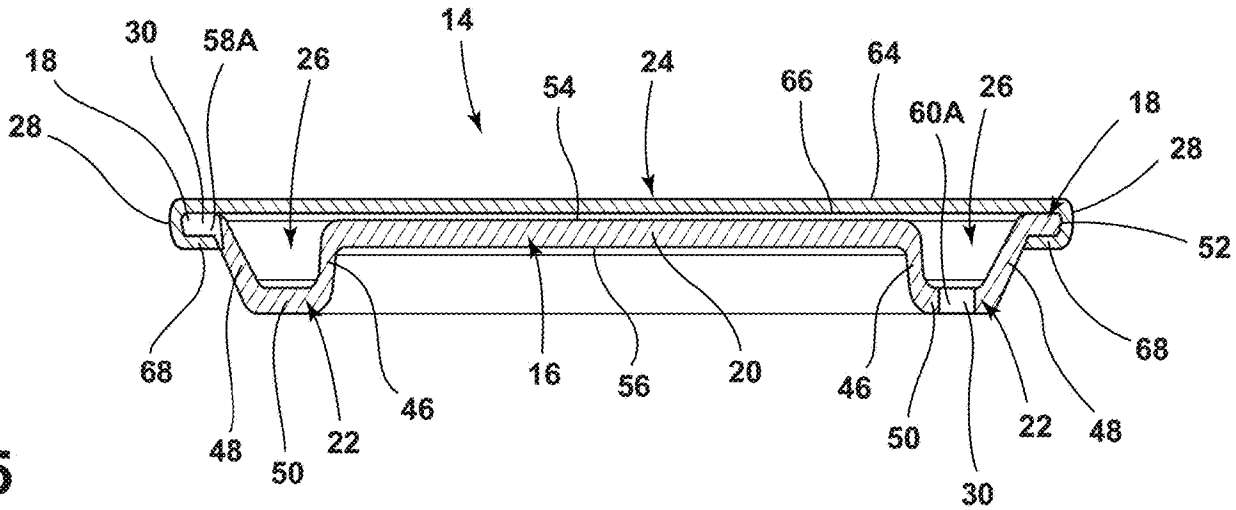
FIG. 5 is an enlarged cross-sectional view of the burner cap of FIG. 4 taken through line V-V.
Figure 7:
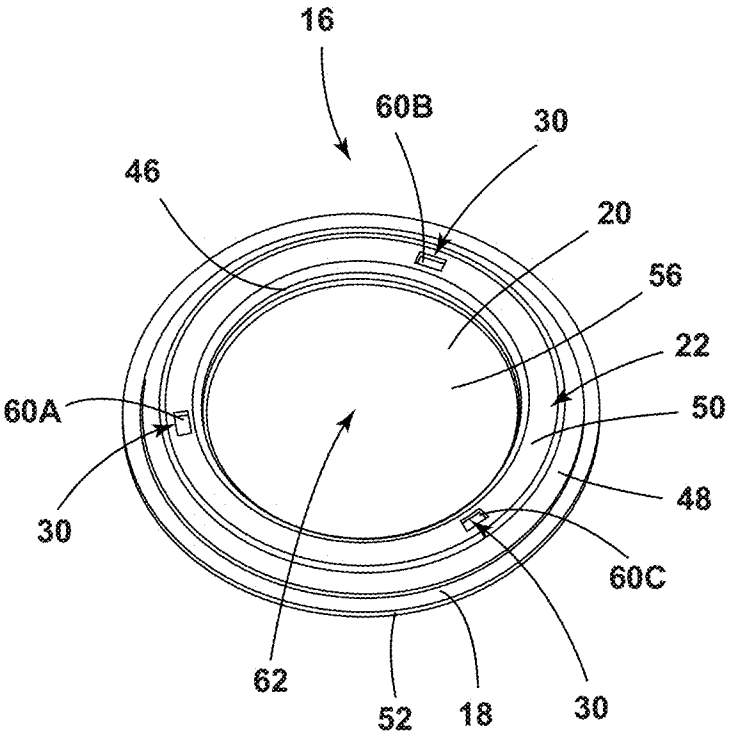
FIG. 7 is a bottom perspective view of a base of a burner cap.
Figure 6:
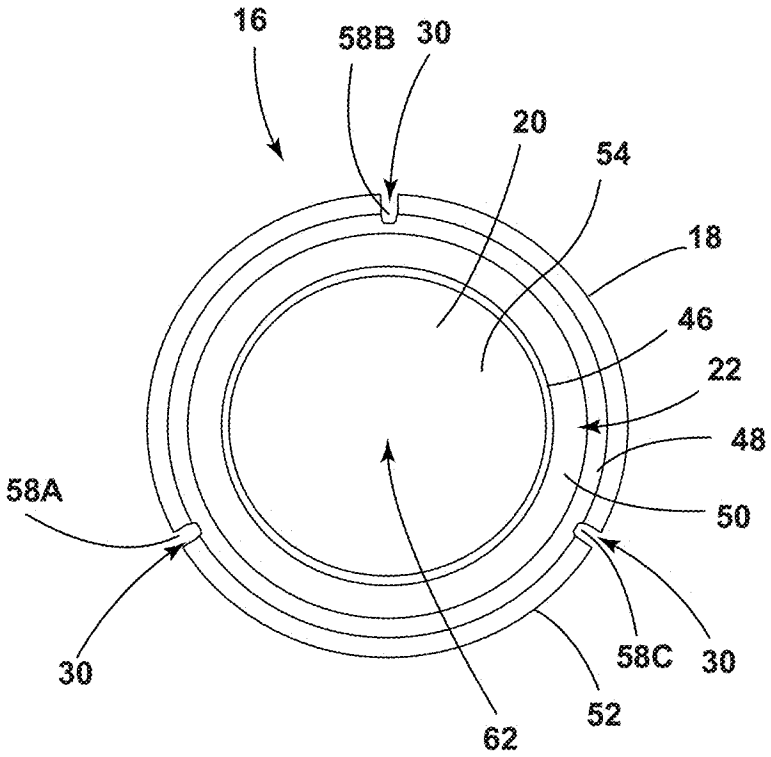
FIG. 6 is a plan view of a base of a burner cap.

As illustrated in FIGS. 5-7, the base 16 of the burner cap 14 includes the inner platform 20. The inner platform 20 is positioned inboard of the peripheral lip 18. In some embodiments, the inner platform 20 is separated from the peripheral lip 18 by the annular trough 22. In other words, the annular trough 22 may be positioned between the peripheral lip 18 and the inner platform 20 of the base 16. As illustrated in FIG. 5, the annular trough 22 includes an inner side wall 46, an outer side wall 48, and a floor 50. The inner side wall 46 extends downward from the inner platform 20 to the floor 50 of the annular trough 22. The floor 50 extends outboard away from the inner platform 20 and the inner side wall 46 to the outer side wall 48. The outer side wall 48 extends upward from the floor 50 to the peripheral lip 18 of the base 16. In the embodiment illustrated in FIG. 5, the peripheral lip 18 extends outward from the outer side wall 48 to an outboard-most edge 52.

As illustrated in FIG. 5, the base 16 includes a top surface 54 and a bottom surface 56 opposite the top surface 54. The bottom surface 56 may face and/or be in contact with the spreader 12 of the burner assembly 10. As described further herein, the top surface 54 may face toward the top 24 of the burner cap 14. In some implementations, the bottom surface 56 of the annular trough 22 may be configured to contact and/or rest upon the spreader 12 of the burner assembly 10. For example, the bottom surface 56 of the floor 50 of the annular trough 22 may be configured to rest on a portion of the spreader 12, in some embodiments.

In some examples, the inner platform 20 may be substantially planar, as illustrated in FIG. 5. In other words, the top surface 54 and/or the bottom surface 56 of the inner platform 20 may be substantially planar surfaces. For example, the inner platform 20 may be substantially planar if the top surface 54 of the inner platform 20 is substantially planar. In some implementations, the top surface 54 of the peripheral lip 18 that extends between the outboard-most edge 52 of the peripheral lip 18 and the outer side wall 48 of the annular trough 22 may be substantially planar. As illustrated in FIG. 5, the top surface 54 of the peripheral lip 18 is substantially parallel to the top surface 54 of the inner platform 20. As described further herein, the top surface 54 of the peripheral lip 18 may be positioned upward further than the top surface 54 of the inner platform 20. In other words, the plane defined by the top surface 54 of the peripheral lip 18 may be positioned further from the floor 50 of the annular trough 22 than the plane defined by the top surface 54 of the inner platform 20.

Referring now to FIGS. 5-7, the base 16 of the burner cap 14 defines at least one port 30. The base 16 of the burner cap 14 may define a plurality of ports 30. In some implementations, the at least one port 30 includes at least one recess 58A, 58B, 58C defined by the peripheral lip 18 of the base 16. For example, as illustrated in FIG. 6, the base 16 of the burner cap 14 includes first, second, and third recesses 58A, 58B, 58C that are defined by the peripheral lip 18. In some implementations, the at least one recess 58A, 58B, 58C extends inboard into the base 16, such that the at least one recess 58A, 58B, 58C is defined by the peripheral lip 18 and the annular trough 22. For example, as illustrated in FIGS. 5 and 6, the at least one recess 58A, 58B, 58C extends inboard into the base 16, such that the at least one recess 58A, 58B, 58C is defined by the peripheral lip 18 and the outer side wall 48 of the annular trough 22. In some implementations, the at least one port 30 includes at least one aperture 60A, 60B, 60C that extends through the base 16. For example, the base 16 may include at least one aperture 60A, 60B, 60C that is defined by the annular trough 22. In the embodiment illustrated in FIG. 7, the base 16 includes first, second, and third apertures 60A, 60B, 60C that are defined by and extend through the floor 50 of the annular trough 22.

Referring now to FIGS. 6 and 7, in some examples, the at least one port 30 may be a plurality of ports 30 defined by the base 16, wherein each of the plurality of ports 30 is positioned substantially equidistant from each adjacent port 30. For example, as illustrated in FIG. 6, the base 16 defines the first, second, and third recesses 58A, 58B, 58C, the first recess 58A is spaced apart from the second and third recesses 58B, 58C (i.e., the recesses adjacent to the first recess 58A) by substantially equal distances, the second recess 58B is spaced apart from the first and third recesses 58A, 58C (i.e., the recesses adjacent to the second recess 58B) by substantially equal distances, and the third recess 58C is spaced apart from the first and second recesses 58A, 58B (i.e., the recesses adjacent to the third recess 58C) by substantially equal distances. Further, as illustrated in FIG. 7, the base 16 defines the first, second, and third apertures 60A, 60B, 60C, the first aperture 60A is spaced apart from the second and third apertures 60B, 60C (i.e., the apertures adjacent to the first aperture 60A) by substantially equal distances, the second aperture 60B is spaced apart from the first and third apertures 60A, 60C (i.e., the apertures adjacent to the second aperture 60B) by substantially equal distances, and the third aperture 60C is spaced apart from the first and second apertures 60A, 60B (i.e., the apertures adjacent to the third aperture 60C) by substantially equal distances. In the embodiments illustrated in FIGS. 6 and 7, the plurality of ports 30 are positioned, such that by drawing radial lines from a center 62 of the base 16 through each of the plurality of ports 30, an angle of about 120 degrees separates each port 30 from the other adjacent ports 30. Embodiments wherein the base 16 defines more or fewer ports 30 that may or may not be equidistant from each other are contemplated.

Figure 4:
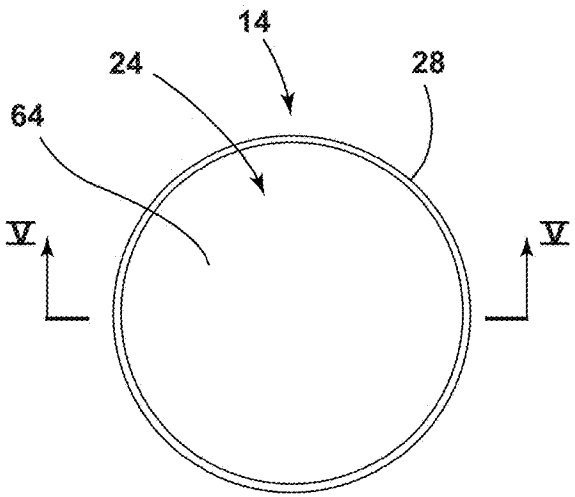
FIG. 4 is a plan view of a burner cap.

Referring now to FIGS. 4 and 5, the burner cap 14 includes the top 24 that extends over the base 16 of the burner cap 14. As illustrated in the plan view of an exemplary embodiment of the burner cap 14 depicted in FIG. 6, the top 24 may be generally disc-shaped. In other words, from a top-down perspective, the top 24 may have a generally circular outline. As illustrated in FIG. 5, the top 24 may include an upper surface 64 and a lower surface 66 opposite the upper surface 64. The lower surface 66 may face toward the base 16 of the burner cap 14. The upper surface 64 may face away from the base 16 of the burner cap 14. The upper and lower surfaces 64, 66 of the top 24 of the burner cap 14 may border an edge 68 and/or converge to form the edge 68 of the top 24.

As illustrated in FIG. 5, the top 24 of the burner cap 14 includes the peripheral rim 28. The peripheral rim 28 may wrap about at least a portion of the peripheral lip 18 of the base 16. The peripheral rim 28 being wrapped about at least the portion of the peripheral lip 18 may serve to couple the top 24 to the base 16, as depicted in FIG. 5. In various implementations, the peripheral rim 28 of the top 24 may wrap about at least a portion of the peripheral lip 18, in that the peripheral rim 28 extends over the top surface 54 of the peripheral lip 18 and along the outboard-most edge 52 of the peripheral lip 18. In some implementations, the peripheral rim 28 wraps about the peripheral lip 18 via the lower surface 66 of the peripheral rim 28 contacting the top surface 54 of the peripheral lip 18, the outboard-most edge 52 of the peripheral lip 18, and/or the bottom surface 56 of the peripheral lip 18. For example, as illustrated in FIG. 5, the lower surface 66 of the peripheral rim 28 is in contact with at least a portion of each of the top surface 54, the outboard-most edge 52, and the bottom surface 56 of the peripheral lip 18. In some implementations, the peripheral rim 28 may be crimped about the peripheral lip 18 of the base 16 of the burner cap 14. In some embodiments, the peripheral rim 28 may wrap about a portion of the at least one recess 58 defined by the peripheral lip 18. For example, in the embodiment illustrated in FIG. 5, the peripheral rim 28 extends over a portion of the recess 58A defined by the peripheral lip 18.

As illustrated in FIG. 4, the top 24 extends inboard from the peripheral rim 28 over the base 16 of the burner cap 14. The top 24 may be substantially planar inboard of the peripheral rim 28. In other words, the portion of the upper surface 64 of the top 24 that is inboard of the peripheral rim 28 may be a substantially planar surface. In some examples, the inner platform 20 of the base 16 may be substantially parallel to the top 24 inboard of the peripheral rim 28. In other words, the at least one plane of the top and/or bottom surfaces 54, 56 of the inner platform 20 may be substantially parallel to the plane of the upper surface 64 of the top 24 inboard of the peripheral rim 28, as illustrated in FIG. 5.

Referring now to FIG. 5, the top 24 may extend over the base 16, such that the gap 26 is defined between the top 24 and the base 16. The gap 26 may extend between the top surface 54 of the base 16 and the lower surface 66 of the top 24. In some examples, the inner platform 20 of the base 16 and the top 24 may be in a spaced relationship, such that the gap 26 extends between the inner platform 20 and the top 24. In the embodiment illustrated in FIG. 5, the top 24 surface of the inner platform 20 and the lower surface 66 of the top 24 are in a spaced relationship, such that the top surface 54 of the inner platform 20 is not in contact with the lower surface 66, and the gap 26 extends there-between. In some implementations, the floor 50 of the annular trough 22 of the base 16 may be a first distance from the top 24, and the inner platform 20 may be a second distance from the top 24, wherein the first distance is greater than the second distance. In other words, as illustrated in FIG. 5, the gap 26 may be deeper between the floor 50 of the annular trough 22 and the top 24 than between the inner platform 20 and the top 24.

Referring still to FIG. 5, in various implementations, the at least one port 30 defined by the base 16 of the burner cap 14 may be configured to allow air to flow into and out of the gap 26 defined by the top 24 and the base 16. As illustrated in FIG. 5, neither the at least one recess 58A nor the at least one aperture 60A defined by the base 16 is sealed off by the top 24 of the burner cap 14. As such, the gap 26 is in communication with an exterior environment of the burner cap 14 via the at least one port 30 defined by the base 16.

The present disclosure may provide a variety of advantages. First, forming the top 24 and the base 16 of the burner cap 14 from sheet metal may be considerably less expensive than a cast iron burner cap or a burner cap formed using metal powder. Second, forming the top 24 and the base 16 of the burner cap 14 from sheet metal may allow for quicker cooling of the burner cap 14 after use compared to conventional metal powder or cast iron burner caps. Third, the at least one port 30 defined by the base 16 allows air and other gases to enter and exit the gap 26 between the top 24 and the base 16 of the burner cap 14, which may prevent deformation-inducing gas build up within the gap 26 during the manufacturing process, and may prevent deformation of burner caps 14 during use by allowing hot, expanding air within the gap 26 to escape to the exterior environment of the burner cap 14. Fourth, the at least one port 30 defined by the base 16 may allow liquids that seep into the gap 26 to dry efficiently and/or be expelled from the gap 26, which may aid in preventing rusting of the burner cap 14 and allow for convenient cleaning of the burner cap 14.

According to an aspect of the present disclosure, a burner cap includes a sheet metal base. The sheet metal base includes a peripheral lip that bounds the sheet metal base, an inner platform positioned inboard of the peripheral lip, and an annular trough positioned between the peripheral lip and the inner platform. The burner cap also includes a sheet metal top that extends over the sheet metal base to define a gap there-between and that has a peripheral rim that wraps about at least a portion of the peripheral lip to couple the sheet metal top to the sheet metal base. The sheet metal base defines at least one port configured to allow air to flow into and out of the gap.

According to another aspect, the at least one port includes at least one recess defined by the peripheral lip of the sheet metal base.

According to another aspect, the at least one port includes at least one aperture defined by the annular trough of the sheet metal base.

According to another aspect, the at least one port includes a plurality of ports defined by the sheet metal base, wherein each of the plurality of ports is positioned substantially equidistant from each adjacent port.

According to another aspect, the inner platform and the sheet metal top are in a spaced relationship, such that the gap extends between the inner platform and the sheet metal top.

According to another aspect, the sheet metal top is substantially planar inboard of the peripheral rim.

According to another aspect, the inner platform is substantially planar, such that the inner platform is substantially parallel to the sheet metal top inboard of the peripheral rim.

According to another aspect, the annular trough includes a floor, wherein the floor is a first distance from the sheet metal top, the inner platform is a second distance from the sheet metal top, and the first distance is greater than the second distance.

According to another aspect of the present disclosure, a burner assembly includes a spreader and a burner cap coupled to the spreader. The burner cap includes a sheet metal base bounded by a peripheral lip and a sheet metal top extending over the sheet metal base to define a gap and having a peripheral rim that wraps about at least a portion of the peripheral lip. The sheet metal base defines at least one port configured to allow air to flow into and out of the gap.

According to another aspect, the at least one port includes at least one recess defined by the peripheral lip of the sheet metal base.

According to another aspect, the peripheral rim wraps about a portion of the at least one recess defined by the peripheral lip.

According to another aspect, the sheet metal base includes an inner platform positioned inboard of the peripheral lip and an annular trough positioned between the peripheral lip and the inner platform, wherein the annular trough contacts the spreader.

According to another aspect, the at least one port includes at least one aperture defined by the annular trough of the sheet metal base.

According to another aspect, the annular trough includes a floor, wherein the floor is a first distance from the sheet metal top, the inner platform is a second distance from the sheet metal top, and the first distance is greater than the second distance.

According to yet another aspect of the present disclosure, a burner cap includes a base bounded by a peripheral lip and a top extending over the base to define a gap between the top and the base and having a peripheral rim that wraps about at least a portion of the peripheral lip, wherein the base defines at least one port configured to allow air to flow into and out of the gap.

According to another aspect, the at least one port includes at least one recess defined by the peripheral lip of the sheet metal base.

According to another aspect, the peripheral rim wraps about a portion of the at least one recess defined by the peripheral lip.

According to another aspect, the at least one recess includes a plurality of recesses defined by the peripheral lip, wherein each of the plurality of recesses is positioned substantially equidistant from each adjacent recess.

According to another aspect, the top is substantially planar inboard of the peripheral rim.

According to another aspect, the top is comprised of sheet metal, and the base is comprised of sheet metal.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

What is claimed is:

1. A burner cap, comprising:

a sheet metal base, comprising:

a peripheral lip that bounds the sheet metal base;

an inner platform positioned inboard of the peripheral lip; and an annular trough positioned between the peripheral lip and the inner platform;

and a sheet metal top that extends over the sheet metal base to define a gap there-between and having a peripheral rim that wraps about at least a portion of the peripheral lip to couple the sheet metal top to the sheet metal base, wherein the sheet metal base defines at least one port configured to allow air to flow into and out of the gap, and wherein the at least one port includes at least one of a recess defined by the peripheral lip of the sheet metal base and an aperture defined by the annular trough of the sheet metal base.

2. The burner cap of claim 1, wherein the at least one port comprises:

a plurality of ports defined by the sheet metal base, wherein each of the plurality of ports is positioned substantially equidistant from each adjacent port.

3. The burner cap of claim 1, wherein the inner platform and the sheet metal top are in a spaced relationship, such that the gap extends between the inner platform and the sheet metal top.

4. The burner cap of claim 3, wherein the sheet metal top is substantially planar inboard of the peripheral rim.

5. The burner cap of claim 4, wherein the inner platform is substantially planar, such that the inner platform is substantially parallel to the sheet metal top inboard of the peripheral rim.

6. The burner cap of claim 1, wherein the annular trough comprises:

a floor, wherein the floor is a first distance from the sheet metal top, the inner platform is a second distance from the sheet metal top, and the first distance is greater than the second distance.

7. A burner assembly, comprising:

a spreader; and a burner cap coupled to the spreader, the burner cap comprising:

a sheet metal base bounded by a peripheral lip; and a sheet metal top extending over the sheet metal base to define a gap and having a peripheral rim that wraps about at least a portion of the peripheral lip, wherein the sheet metal base defines at least one port configured to allow air to flow into and out of the gap unobstructed by the spreader.

8. The burner assembly of claim 7, wherein the at least one port comprises:

at least one recess defined by the peripheral lip of the sheet metal base.

9. The burner assembly of claim 8, wherein the peripheral rim wraps about a portion of the at least one recess defined by the peripheral lip.

10. The burner assembly of claim 7, wherein the sheet metal base comprises:

an inner platform positioned inboard of the peripheral lip; and an annular trough positioned between the peripheral lip and the inner platform, wherein the annular trough contacts the spreader.

11. The burner assembly of claim 10, wherein the at least one port comprises:

at least one aperture defined by the annular trough of the sheet metal base.

12. The burner assembly of claim 10, wherein the annular trough comprises:

a floor, wherein the floor is a first distance from the sheet metal top, the inner platform is a second distance from the sheet metal top, and the first distance is greater than the second distance.

13. A burner cap, comprising:

a base bounded by a peripheral lip; and a top extending over the base to define a gap between the top and the base and having a peripheral rim that wraps about at least a portion of the peripheral lip, wherein the base defines at least one port configured to allow air to flow into and out of the gap, and wherein the at least one port includes at least one recess defined by the peripheral lip of the base.

14. The burner cap of claim 13, wherein the peripheral rim wraps about a portion of the at least one recess defined by the peripheral lip.

15. The burner cap of claim 13, wherein the at least one recess comprises:

a plurality of recesses defined by the peripheral lip, wherein each of the plurality of recesses is positioned substantially equidistant from each adjacent recess.

16. The burner cap of claim 13, wherein the top is substantially planar inboard of the peripheral rim.

17. The burner cap of claim 13, wherein the top is comprised of sheet metal, and the base is comprised of sheet metal.

18. The burner cap of claim 1, wherein the at least one port includes the at least one recess defined by the peripheral lip of the sheet metal base.

19. The burner cap of claim 1, wherein the at least one port includes the at least one aperture defined by the annular trough of the sheet metal base.

* * * * *